US005816553A

United States Patent [19]

Brown

[11] Patent Number: 5,816,553

[45] Date of Patent: Oct. 6, 1998

[54] PAPER ROLL HOLDER

[75] Inventor: Ronald G. Brown, Pittsburg, Kans.

[73] Assignee: ETCO Specialty Products, Inc., Girard, Kans.

[21] Appl. No.: 792,846

[22] Filed: Feb. 3, 1997

[51] Int. Cl.[6] ..... A47F 5/00

[52] U.S. Cl. ..... 248/309.2; 248/903; 242/570; D6/521

[58] Field of Search ..... 248/309.2, 205.3, 248/176.1, 903; 211/6–8, 16, 87; 242/129.5, 560.2, 570, 590, 597.7, 597.8, 600, 899, 917; D6/518, 520, 521

[56] References Cited

U.S. PATENT DOCUMENTS

| | | | |
|---|---|---|---|
| D. 260,828 | 9/1981 | Cordray | D6/97 |
| D. 378,177 | 2/1997 | Zapp | D6/521 |
| 1,069,961 | 8/1913 | Kuczynski | D6/521 |
| 4,553,711 | 11/1985 | Urion | 242/55.3 |
| 4,717,106 | 1/1988 | Bies | 248/309.2 |

*Primary Examiner*—Leslie A. Braun
*Assistant Examiner*—Gwendolyn W. Baxter
*Attorney, Agent, or Firm*—Litman, McMahon & Brown, L.L.C.

[57] ABSTRACT

A holder for paper rolls includes a base with a plate having a receiver and a stem for extending through the base plate receiver. The stem is releasably retained in the base plate receiver by an annular snap ring in the base plate receiver engaging an annular groove in the stem. A mounting system for mounting the base on a structure includes either screw anchors and screws or an adhesive fastener such as two-sided tape.

8 Claims, 2 Drawing Sheets

PAPER ROLL HOLDER

BACKGROUND OF THE INVENTION

1. Field of the Invention

The present invention relates generally to holders for paper rolls, and in particular to a wall-mounted holder for paper rolls with hollow cores.

2. Description of the Related Art

Various paper products are commonly sold in rolls comprising interconnected, tear-off sheets. Such paper products include toilet paper, paper towels, etc. Many of these paper products are wound on hollow cardboard center cores, which can provide a convenient structure for mounting the paper roll by extending an appropriate stem or spindle through the core passage.

For convenience, paper rolls are often mounted on vertical surfaces, such as walls and cabinets, for easy access. Prior art paper roll holders include clevis-type holders with spring-loaded plungers extending through the paper roll core between the clevis arms whereby the paper roll can rotate. Various types of plungers, shafts and axles have previously been utilized for rotatably mounting paper rolls. The stem or spindle-type holders generally include vertical shafts which extend into the paper roll cores for rotatably mounting the paper rolls thereon. Changing paper rolls on stem-type holders is relatively easy since the old, empty core merely needs to be lifted off and the new paper roll lowered onto the shaft. Simplicity of roll-changing is an advantage of stem or spindle-type holders. Other types of holders, on the other hand, often require compressing a plunger or some other mechanism or spreading a clevis in order to change the paper rolls.

The prior art includes the toilet tissue holder shown in U.S. Pat. No. Des. 260,828. Although this holder is relatively easy to use, its one-piece construction can present disadvantages associated with manufacturing by means of molding techniques. More specifically, simpler and less expensive molding procedures can be utilized by providing a separate stem and base, as compared with the one-piece construction of the holder shown in the aforementioned '828 patent. Another disadvantage of this prior art holder is that it occupies a relatively large space and can be relatively expensive to ship due to its bulkiness.

The paper roll holder of the present invention addresses some of these problems associated with prior art paper roll holders. Heretofore there has not been available a paper roll holder with advantages and features of the present invention.

SUMMARY OF THE INVENTION

In the practice of the present invention, a wall-mounted holder is provided for paper rolls comprising a paper product wound on a hollow, tubular core. The holder generally comprises a base, a stem removably mounted on the base and a mounting system for mounting the holder base on a structure such as a wall or a cabinet. The base includes a plate with a receiver having an annular, inwardly-projecting snap ring. The stem includes an annular groove which selectively receives the snap ring for retaining the stem in position on the base. The mounting system includes screw anchors for inserting into a wall constructed of a material such as gypsum board and screws for connecting the base to the screw anchors. The mounting system also includes adhesive mounting means for adhesively mounting the holder base to a structure. The adhesive mounting means can comprise, for example, two-sided tape.

OBJECTS AND ADVANTAGES OF THE INVENTION

The principle objects and advantages of the present invention include: providing a holder for paper rolls; providing such a holder which is adapted for mounting on a structure such as a wall or cabinet; providing such a holder which includes a base and a stem adapted for removable mounting on the base; providing such a holder which can be assembled by snapping together its base and stem; providing such a holder which can be mounted on a structure by either mechanical or adhesive fasteners; providing such a holder which is relatively compact in its disassembled configuration; providing such a holder which is relatively easy to manufacture using conventional plastic molding equipment; providing such a holder which facilitates quick changing and replacement of paper rolls; providing such a holder which is attractive and unobtrusive; and providing such a holder which is efficient in operation, capable of a long operating life, simple to manufacture and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
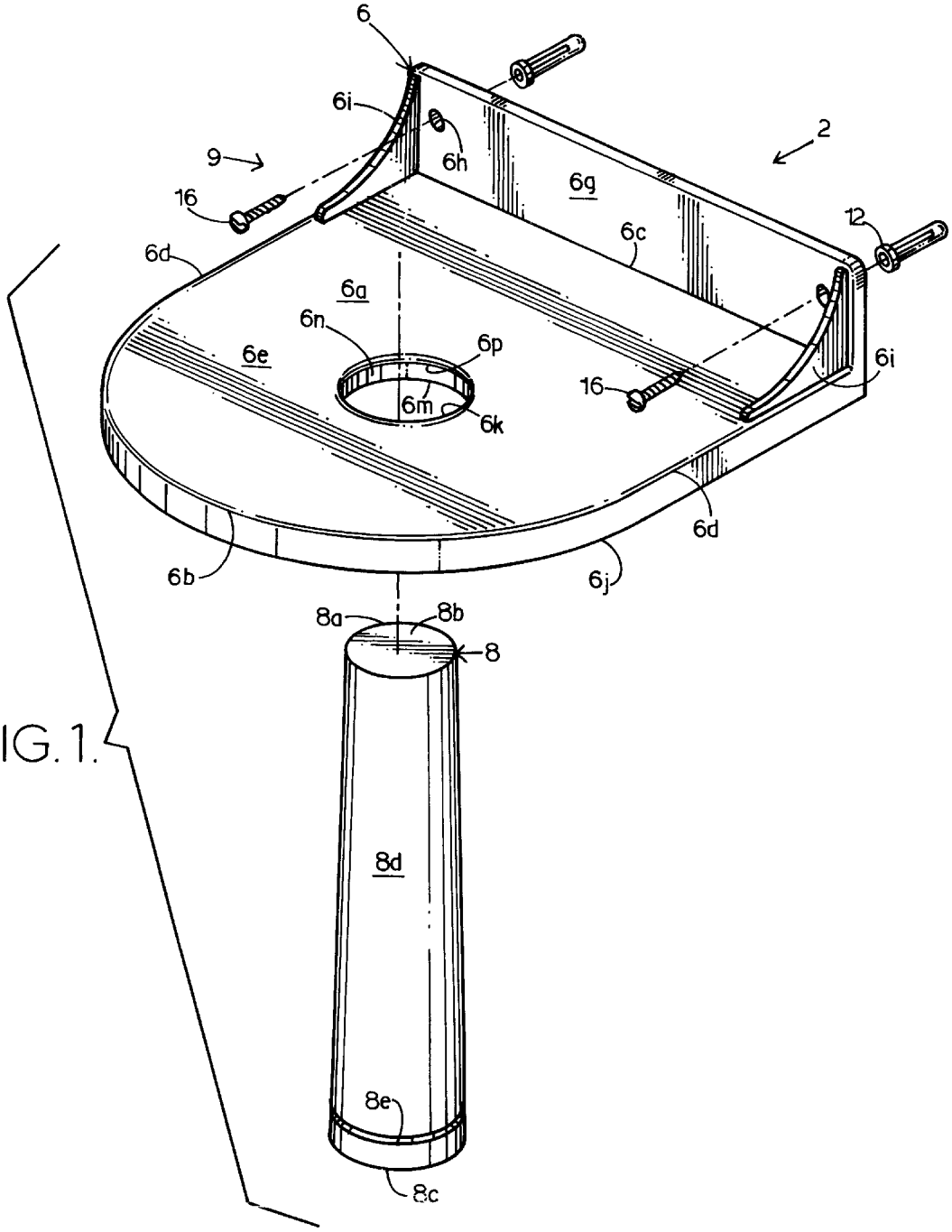
FIG. 1 is an upper, front perspective view of a paper roll holder embodying the present invention, shown in a disassembled configuration thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates a holder for a paper roll 4 of the type which includes a center, hollow, tubular core 4*a* upon which a strip of paper or separable sheets are wound. Various types of paper products are manufactured in this manner and are used in a wide variety of domestic and other applications.

The holder 2 generally comprises a base 6, a stem 8 and a mounting system 9.

II. Base 6

The base 6 generally comprises a plate 6*a,* with a curved, outwardly-convex front edge 6*b,* a generally straight back edge 6*c* and opposite side edges 6*d.* The plate 6*a* includes upper and lower surfaces 6*e,f.*

A flange 6*g* extends upwardly from the base upper surface 6*e* along its back edge 6*c* and generally between the base plate side edges 6*d.* The flange 6*g,* includes a pair of holes 6*h* each located adjacent a respective side edge 6*d.* A pair of gussets 6*i* are connected to the plate upper surface 6*e.* Each gusset 6*i* is also connected to the flange 6*g* adjacent to a respective plate side edge 6*d.* A plate rim 6*j* depends downwardly from the plate 6*a* at the plate edges 6*b,c,d* for stiffening and strengthening the base 6.

A receiver 6*k* is formed in the base plate 6*a* between the front and back edges 6*b,c* and midway between the side edges 6*d* thereof. A receiver rim 6*m* depends downwardly from the plate lower surface 6*f,* and forms a receiver perimeter 6*n* defining a receiver inside diameter ID.1. An annular snap ring 6*p* projects inwardly from the receiver perimeter 6*n* into the receiver 6*k* and defines a snap ring inside diameter, ID.2. The snap ring 6*p* is located in proximity to the base upper surface 6*e,* but could be located at other positions along the receiver perimeter 6*n.*

III. Stem 8

The stem 8 includes an upper end 8*a* closed by a generally circular stem top 8*b* and an open, lower end 8*c*. The stem 8 also includes a sidewall 8*d* with a generally frusto-conical configuration. An annular groove 8*e* is formed in the sidewall 8*d* in closely-spaced proximity to the stem lower end 8*c*. The groove 8*e* has a generally V-shaped cross-sectional configuration and is sized to releasably receive the snap ring 6*p*.

The stem 8 has a first outside diameter OD.1 at its upper end 8*a* which is less than the snap ring inside diameter ID.2. A second outside diameter OD.2 is located just above the groove 8*e* and is slightly greater than the snap ring inside diameter ID.2 whereby the snap ring 6*p* expands slightly to accept the stem 8 until the groove 8*e* receives the snap ring 6*p* in a retaining engagement. The stem 8 has a third outside diameter OD.3 adjacent to its lower end 8*c* to resist pullthrough past the snap ring 6*p*.

IV. Mounting System 9

Figure 2:
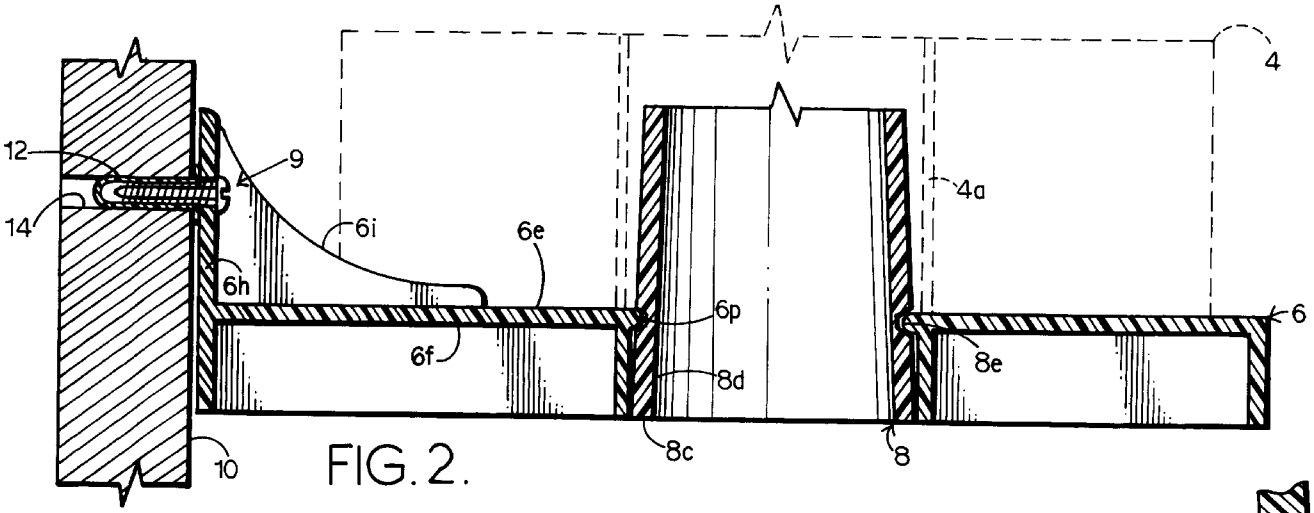
FIG. 2 is an enlarged, longitudinal cross-sectional view of the holder, shown mounted on a structure with a screw and a screw anchor.
Figure 3:
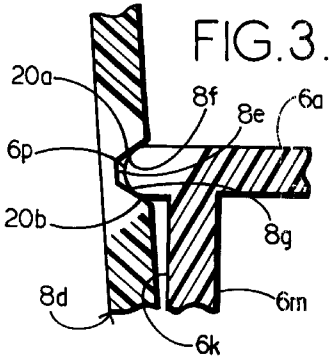
FIG. 3 is an enlarged, fragmentary, vertical, cross-sectional view of the holder taken generally within circle 3 in FIG. 2 and particularly showing the interconnection of a snap ring and a stem groove.
Figure 4:
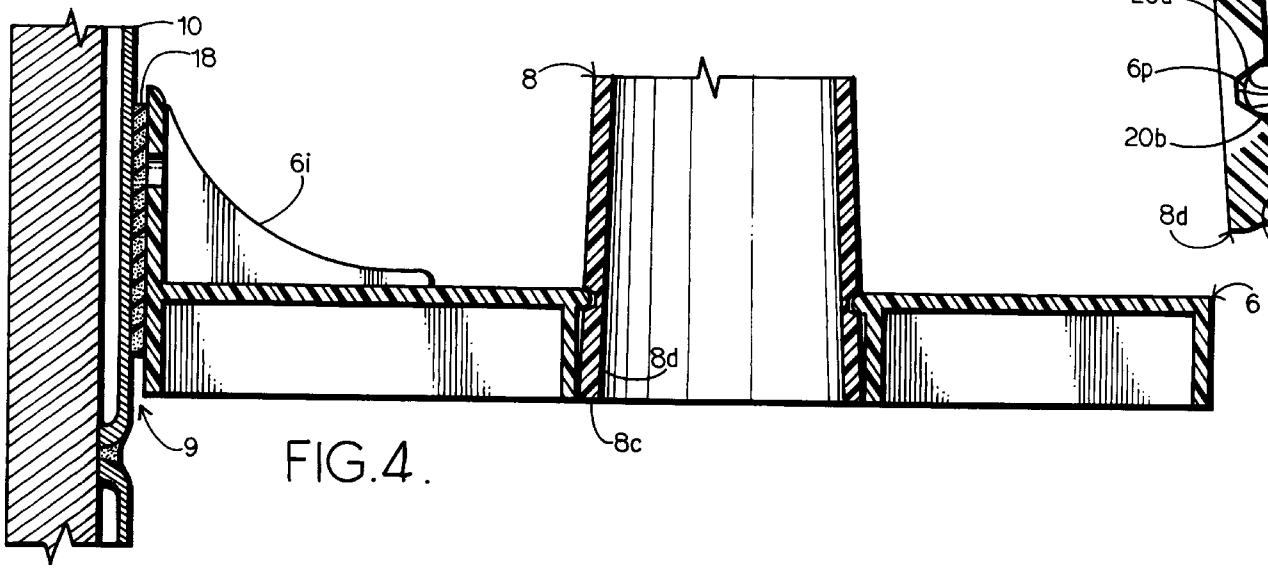
FIG. 4 is a vertical, longitudinal, cross-sectional view of the holder, showing the mounting thereof on a structure by adhesive means for mounting same, which adhesive means comprise two-sided tape.

The holder 2 can be mounted on structures 10 with a wide variety of different constructions and comprising a wide range of different materials. For example, as shown in FIG. 2, screw anchors 12 can be inserted into holes 14 formed in a wall 10. The screw anchors 12 can then receive mounting screws 16 extending through the flange holes 6*h*. Alternatively, as shown in FIG. 4, adhesive means comprising double-sided tape 18, can be applied to the flange 6*g* and adhesively mount same on the wall 10.

For mounting on ceramic tile surfaces, the double-sided tape 18 is preferably used to avoid having to drill holes through tiles. For many other types of wall materials, the anchors 12 and the mounting screws 16 can be used. For screw-mounting installations, the flange holes 6*h* can be used for template purposes for premarking the hole locations whereafter appropriately-sized holes 14 can be drilled to receive the screw anchors 12 and the holder 2 can be mounted by means of the mounting screws 16 extending through the flange holes 6*h*.

V. Operation

In operation, the holder 2 can be assembled by inserting the stem 6 upwardly through the receiver 6*k* until the snap ring 6*p* engages in the groove 8*e*. The snap ring 6*p* preferably forms upper and lower annular contact lines 20*a,b* with upper and lower faces 8*f,g* of the V-shaped groove 8*e*. Engagement of the stem lower end 8*c* with the receiver perimeter 6*n* further increases the strength of the base-to-stem connection.

The holder 2 can be mounted on the wall 10 at a convenient location by one of the alternative mounting methods described herein, or by some other suitable mounting method. The properly positioned holder 2 is adapted to receive a paper roll 4, with the frusto-conical configuration of the stem 8 designed to facilitate its insertion into the paper roll core 4*a*.

It is to be understood that while certain forms of the present invention have been illustrated and described herein, it is not to be limited to the specific forms or arrangement of parts described and shown.

What is claimed and desired to be secured by letters patent is as follows:

1. A paper roll holder, which includes:

(a) a base having:
  (1) a plate with upper and lower surfaces, a front edge, a back edge and opposite side edges;
  (2) a flange mounted on the plate back edge and extending upwardly therefrom;
  (3) a pair of gussets each connected to the plate adjacent a side edge thereof and to said flange; and
  (4) an edge rim depending downwardly from said base edges;

(b) a receiver formed in said base plate in spaced relation inwardly from said edges thereof, said receiver including a receiver rim depending downwardly from said plate and defining a receiver perimeter, a snap ring extending inwardly from said receiver perimeter and including an annular inner edge, and a snap ring inside diameter formed by said snap ring inner-edge; and (c) a stem including:
  (1) an upper end;
  (2) a lower end;
  (3) a stem sidewall having a frusto-conical configuration converging upwardly;
  (4) an annular groove open at said sidewall and located in spaced relation above said lower end;
  (5) said stem having a first outside diameter at said upper end;
  (6) said stem having a second outside diameter greater than said snap ring inside diameter and said first outside diameter at a location on said stem sidewall above said groove; and
  (7) said stem having a second outside diameter below said groove greater than said second outside diameter.

2. The paper roll holder of claim 1, which includes:

(a) a pair of mounting receivers each located in said flange in proximity to a respective base side edge.

3. The paper roll holder of claim 2, which includes:

(a) mechanical fastener mounting means extending through said flange receivers.

4. The paper roll holder of claim 1, which includes:

(a) said plate front edge having a rounded, outwardly-convex configuration.

5. The paper roll holder of claim 1, which includes:

(a) said groove having an inwardly-converging cross-sectional configuration;

(b) said snap ring inner edge having a generally inwardly-convex cross-sectional configuration.

6. The paper roll holder according to claim 1 wherein said stem upper end has a generally circular, closed top.

7. The paper roll holder of claim 1, which includes:

(a) adhesive mounting means for mounting said flange on a structure.

8. A paper roll holder, which includes:

(a) a base having:

(1) a plate with a rounded, outwardly-convex front edge, a generally straight back edge and opposite side edges;

(2) a flange extending upwardly from said back edge and extending generally between said side edges;

(3) an edge rim depending downwardly from said base edges;

(4) a pair of mounting receiver openings each located in said flange adjacent to a respective side edge;

(5) a pair of gussets each attached to said base upper surface adjacent to the back edge and a respective side edge of the base and to said flange;

(b) a stem having:

(1) a stem receiver located between said base front and back edges and located medially between said base side edges;

(2) a receiver rim depending downwardly from said base lower surface;

(3) a receiver perimeter formed by said receiver rim; and (4) a snap ring projecting inwardly from said receiver perimeter and having a snap ring inside diameter;

(c) a stem including:

(1) an upper end;

(2) a lower end;

(3) a generally circular top closing said upper end;

(4) a sidewall having a generally frusto-conical configuration;

(5) an annular, inwardly-converging groove formed in said sidewall and open thereat;

(6) a first outside diameter at said stem upper end;

(7) a second outside diameter above said groove, said second outside diameter being greater than said first outside diameter and said snap ring diameter;

(8) a third outside diameter at said stem lower end; and (d) mechanical mounting means for mounting said base comprising:

(1) a pair of anchors for placement in the wall; and (2) a pair of mechanical fasteners each received in a respective flange receiver and in a respective anchor.

* * * * *